US006745969B1

(12) United States Patent
Gouda

(10) Patent No.: US 6,745,969 B1
(45) **Date of Patent: *Jun. 8, 2004**

(54) PULL-CORD KEEPER

(75) Inventor: William C. Gouda, Princeton, NJ (US)

(73) Assignee: New Spin Corporation, Princeton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/336,309

(22) Filed: Jan. 3, 2003

(51) Int. Cl.[7] ..... B65H 75/48; E06B 9/30

(52) U.S. Cl. ..... 242/375; 242/376; 242/379; 160/178.1 R

(58) Field of Search ..... 242/376, 375, 242/379, 378, 375.1, 375.2; 160/173 R, 178.1 R

(56) References Cited

U.S. PATENT DOCUMENTS

| | | | | | |
|---|---|---|---|---|---|
| 1,446,410 | A | | 2/1923 | Bennett et al. | |
| 2,187,458 | A | | 1/1940 | Lawson | 160/178.1 R |
| 3,123,130 | A | | 3/1964 | Fridlund | 160/168.1 R |
| 3,384,321 | A | * | 5/1968 | Becker et al. | 242/375 |
| 3,465,806 | A | | 9/1969 | Sulkes | 160/84.06 |
| 4,271,893 | A | | 6/1981 | McCluskey | 160/178 |
| 4,443,944 | A | | 4/1984 | Beesley | 33/138 |
| 4,543,806 | A | | 10/1985 | Papandrea et al. | 70/30 |
| 5,094,396 | A | * | 3/1992 | Burke | 242/375 |
| 5,279,473 | A | | 1/1994 | Rozon | |
| 5,354,011 | A | | 10/1994 | Rozon | 242/402 |
| 5,553,650 | A | | 9/1996 | Jelic | 160/178.1 |
| 5,630,456 | A | | 5/1997 | Hugo et al. | 160/173 |
| 5,683,054 | A | * | 11/1997 | Chen | 242/376 |
| 5,699,975 | A | | 12/1997 | Paugh et al. | 242/371 |
| 5,762,281 | A | | 6/1998 | Foley | 160/178.1 R |
| 5,791,580 | A | | 8/1998 | Anderson et al. | 242/378.4 |
| 5,855,335 | A | * | 1/1999 | Hanna | 242/375.2 |
| 5,918,658 | A | | 7/1999 | Schartner | 160/178.1 R |
| 6,152,392 | A | * | 11/2000 | Hawkins | 242/379 |
| 6,463,986 | B1 | | 10/2002 | Gouda | 160/178.1 R |

* cited by examiner

*Primary Examiner*—John M. Jillions
(74) *Attorney, Agent, or Firm*—Kenneth Watov; Watov & Kipnes, P.C.

(57) ABSTRACT

A pull-cord keeper provided for a window treatment assembly, where the keeper comprises a housing configured for secure mounting attachment on a wall near an upper portion of the window treatment assembly, the housing further defining a cavity therein; an opening in communication with the cavity; a spool adapted for rotational movement within the cavity to reel and collect through the opening a length of a slender, flexible material; and a sealed spring cartridge assembly for spring biasing the spool in a rotational direction for reeling the length of the slender, flexible material during a constant spring-loaded state.

20 Claims, 9 Drawing Sheets

PULL-CORD KEEPER

RELATED PATENT

The present invention is related to U.S. Pat. No. 6,463,986, issued Oct. 15, 2002, entitled "Window Treatment Assembly Pull-Cord Keeper," and is owned by the same assignee.

FIELD OF THE INVENTION

The present invention relates generally to cord keepers, and more particularly to cord keepers adapted for window treatment assemblies to take up loose cords, chains, strings, and the like, in order to protect infants and young children from potentially lethal suffocation and entanglement hazards.

BACKGROUND OF THE INVENTION

Pull-cords are utilized in various types of window treatment assemblies for operating and manipulating such window treatment assemblies such as adjusting the level of the window coverings, for example. Typically, the pull-cord consists of a single or multiple strands of threads that are typically tied together or looped. A locking device is usually provided for clamping the cords to hold the window covering at whatever height the user desires by operation of the pull-cords. The pull-cord usually extends from a head rail portion of the window treatment assembly to within a few inches or less from floor level. Such tied or looped pull-cords extending from the window treatment assembly, often presents an attractive danger to infants or young children fascinated with pull-cords. Tragically, many infants and young children playing with such pull-cords, become entangled in the pull-cords resulting in some form of injury, and even death when accidentally hanged by the pull-cords.

For the foregoing reasons, there is a need for a cord keeper which can effectively prevent or minimize such accidents involving infants and young children in a simple and cost effective manner. In addition, it would be desirable to design a cord keeper that is inexpensive and easy to fabricate and use, and has a minimum number of parts while possessing the durability, reliability and strength required to withstand the stress and forces often experienced during operation of window treatment assembly pull-cords. Furthermore, there is a need for a cord keeper that is especially fail-safe, and which does not require separate actions by the user. Such a cord keeper must operate efficiently, yet be aesthetically pleasing and unobtrusive.

SUMMARY OF THE INVENTION

The present invention is generally directed to a window treatment assembly pull-cord keeper comprised of minimal component parts cooperating to form a device mountable on the surface of a wall or window casing, and adapted for continuously collecting or releasing a length of a pull-cord from a window treatment assembly for keeping the pull-cord taut each time the window treatment assembly is adjusted or operated. The pull-keeper of the present invention generally comprises a wall-mountable housing, a cord collecting assembly adapted for collecting a length of a flexible cord, and biased by spring means including a sealed spring cartridge located within the housing, that has an opening for permitting the flexible cord to pass therethrough into the cord collecting assembly.

The window treatment assembly typically includes window covering material or blind: slats extending between a head rail and bottom rail, and two or more lift cords connected to the bottom rail. Within the head rail, there is a cord locking device located therein. Typically, two or more lift cords are connected at one end of the bottom rail, and extend up through the window covering material or blind slats into the head rail. The lift cords then pass through a cord locking device and out of the head rail in a manner where the opposite end of the lift cords, or pull-cord, is accessible to a user. The window shades or blinds are typically raised by the user pulling on the accessible portion of the lift cords, or pull-cord, and are lowered by; releasing the pull-cord. In this manner, the pull-cord can extend downward from the head rail to within a few feet from floor level.

The window treatment assembly pull-cord keeper of the present invention is adapted to be mounted in a manner for keeping the pull-cord out of reach of infants and small children who are typically attracted to the pull-cord, and who are most susceptible to becoming dangerously entangled in the pull-cord. The pull-cord keeper of the present invention operates by collecting the freely suspended length of the pull-cord of the window treatment assembly, and keeping the ends of the pull-cord away from persons of relatively shorter stature, particularly infants and young children. More specifically, the housing of the pull-cord keeper is adapted for secure mounting on the surface of the wall or window casing near the head rail, and the cord collecting assembly located in the housing, draws or releases the pull-cord through the housing opening according to the degree of slackness in the pull-cord. The cord collecting assembly is conveniently driven by the spring means in a constant spring loaded state. The user can raise or lower the bottom rail as desired while the pull-cord keeper simultaneously draws or releases, respectively, a length of the pull-cord while keeping the pull-cord taut and away from the lower end of the window treatment assembly in a safe, efficient and effective manner. When the user is satisfied with the level of the bottom rail (e.g. of a Venetian blind), the cord locking device in the head rail is engaged as usual, and the pull-cord keeper automatically maintains the taut condition in the pull-cord. No separate action on the part of the user is required for operation.

In particular, one aspect of the present invention is directed to a pull-cord keeper for a window treatment assembly, which comprises:

- a wall-mountable housing;
- a cord collecting assembly located within the housing and adapted for collecting a loose length of a flexible cord;
- a spring cartridge including a spring adapted for rotating the cord collecting assembly to collect the loose length of the flexible cord; and
- an opening for permitting the flexible cord to pass therethrough into the housing to the cord collecting assembly.

In another aspect of the present invention, the pull-cord keeper comprises:

- a housing configured for secure mounting attachment on a wall near an upper portion of the window treatment assembly, said housing further defining a cavity therein;
- an opening in communication with said cavity;
- a spool adapted for rotational movement within said cavity to reel and collect through said opening a length of a slender flexible material; and
- a spring cartridge including a spring for biasing the spool in a rotational direction for reeling in any loose length of the slender flexible material during a constant spring loaded state.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

Figure 1:
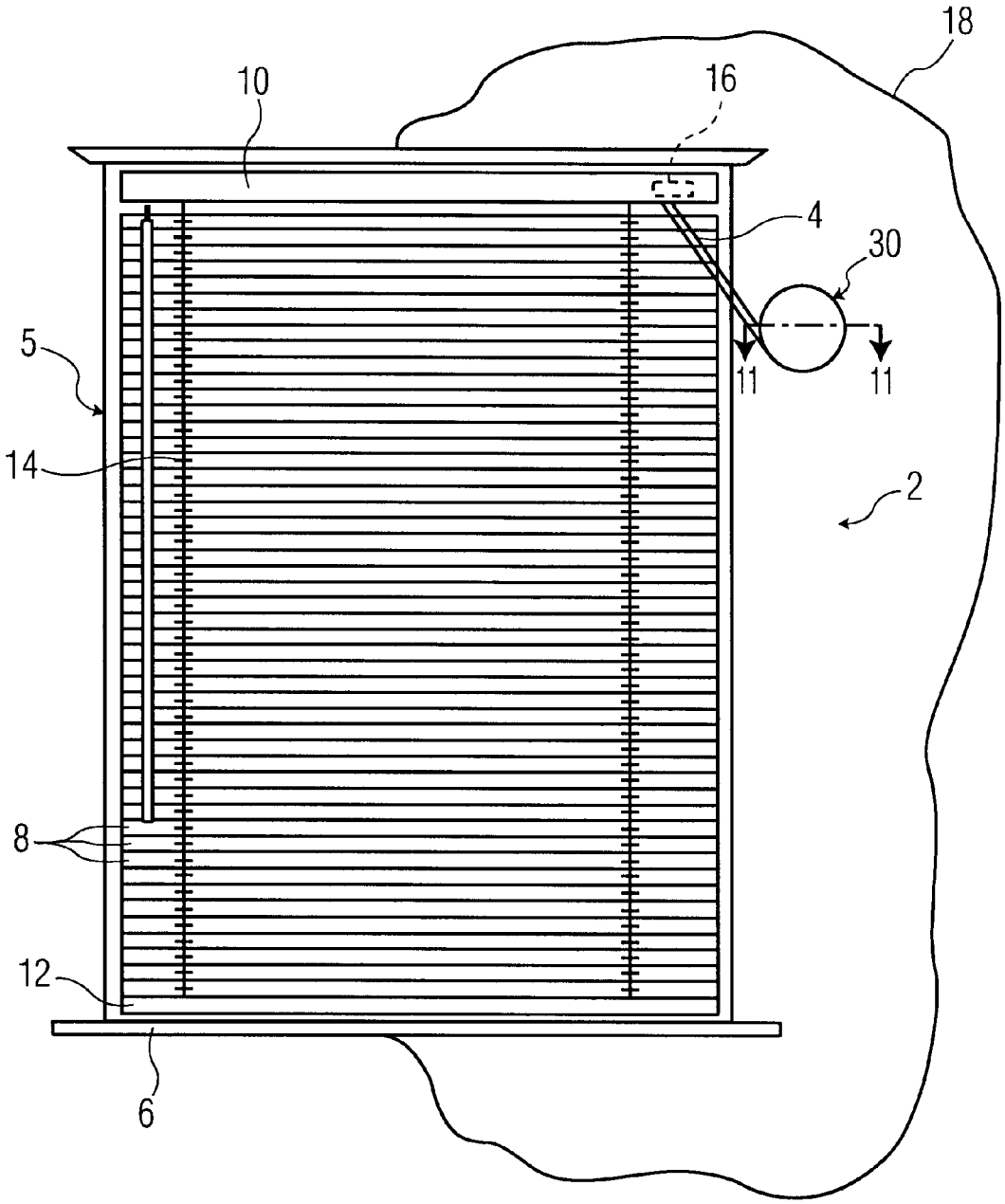
FIG. 1 is a front elevational view of a typical window treatment assembly with a pull-cord keeper of the present invention illustrated in use.

The present invention can be used with any type of window treatment assembly including Venetian blinds, pleated shades, Roman shades, and the like, where a pull-cord is utilized for normal operation. Although one embodiment of the present invention is shown and described in use with Venetian blinds, the invention is not so limited. As an example of the window treatment assembly having a pull-cord which forms a loop is shown in FIG. 1. The window treatment assembly may be a pleated shade, Roman shade, or Venetian blind. When the window covering is in an open position, the pull-cord can typically extend below the window sill to within a few inches from floor level where it can be reached easily by infants and young children.

The window treatment assembly 2 of FIG. 1 is shown in a closed position above a window sill 6 of a window 5. The window treatment assembly 2, in the form of a Venetian blind, typically includes a window covering material or blind slats 8 extending between a head rail 10 and bottom rail 12, and two or more lift cords 14 connected to the bottom rail 12. The head rail 10 is mounted on a top frame 7 of the window 5. A cord locking device 16 is located within the head rail 10. Typically, the two or more lift cords 14 are connected at one end of the bottom rail 12, and extend up through the window covering material or blind slats 8 into the head rail 10. The lift cords 14 then pass through the cord locking device 16 and out of the head rail 10 in a manner where the opposite end of the lift cords, or pull-cord 4, is accessible to a user. The window shades or blind slats 8 are typically raised by disengaging the cord locking device 16 and pulling the pull-cord 4, or lowered by releasing the pull-cord 4. When the user is satisfied with the level of the blind slats 8, the cord locking device 16 is re-engaged to fix the pull-cord 4 in place.

As further shown in FIG. 1, one embodiment of a pull-cord keeper 30 of the present invention is shown in use. The pull-cord keeper 30 is attached to the pull-cord 4 and permanently and securely mounted on a wall portion 18 near the head rail 10 of the window treatment assembly 2. The pull-cord keeper 30 may be mounted on the window casing portion of the window 5 for a more secure structural footing. During use, the pull-cord 4 is kept safely beyond the reach of infants and young children while being easily accessible to operators of the window treatment assembly 2. Also, the pull-cord keeper 30 advantageously does not require any separate actions on the part of the user, nor interfere with the normal operation of the window treatment assembly 2. The user simply operates the window treatment assembly 2 in the normal manner as described above. This self-operating ability enhances the fail-safety of the pull-cord keeper of the present invention.

Figure 2:
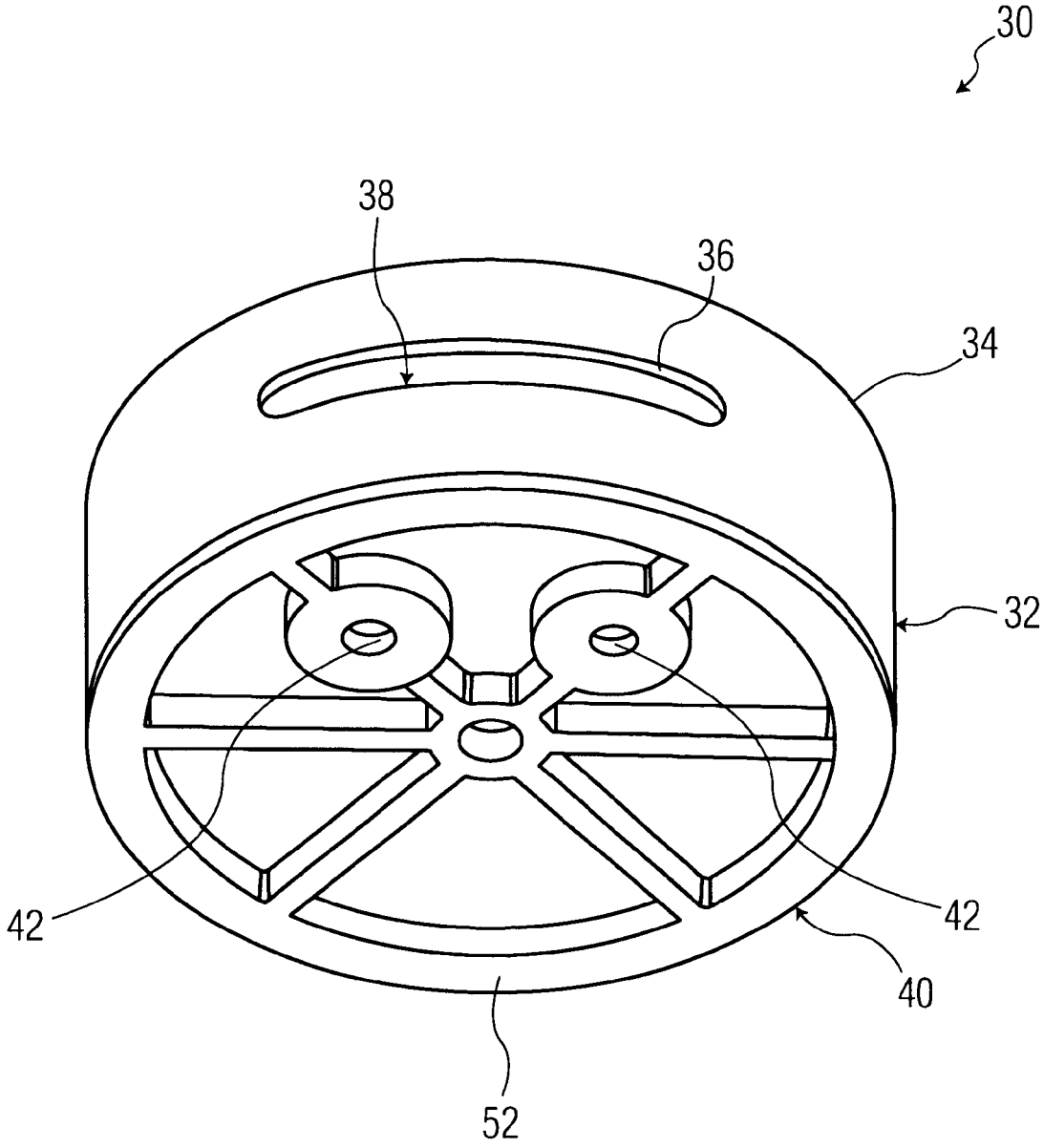
FIG. 2 is a front perspective view looking toward the bottom of a pull-cord keeper constructed in accordance with the teachings of the present invention.

Referring to FIG. 2, the pull-cord keeper 30 is shown set apart from the wall portion 18, looking toward the bottom and front portions. The pull-cord keeper 30 includes a cylindrical housing 32 which is adapted for securely mounting on a flat surface area of a wall or a portion of the window casing. The housing 32 comprises a cylindrical cap or cover member 34 with an opening 36 in communication with an interior cavity 38 defined therein, and a mounting plate 40 with two mounting holes 42 for screw fasteners (not shown). The housing 32 is mounted to the wall 18 on a mounting surface 52 of the plate 40 which is shown hogged out for purposes of saving material and weight. The opening 38 is adapted to receive a free end of the pull-cord 4 and provides the pull-cord 4 access into the cavity 38. During use, the pull-cord keeper 30 retracts or releases the pull-cord 4, through the opening 38 in response to adjustment of the window treatment assembly 2. The opening 38 is elongate in shape and extends circumferentially along a portion of the side of the cover 34.

Figure 3A:
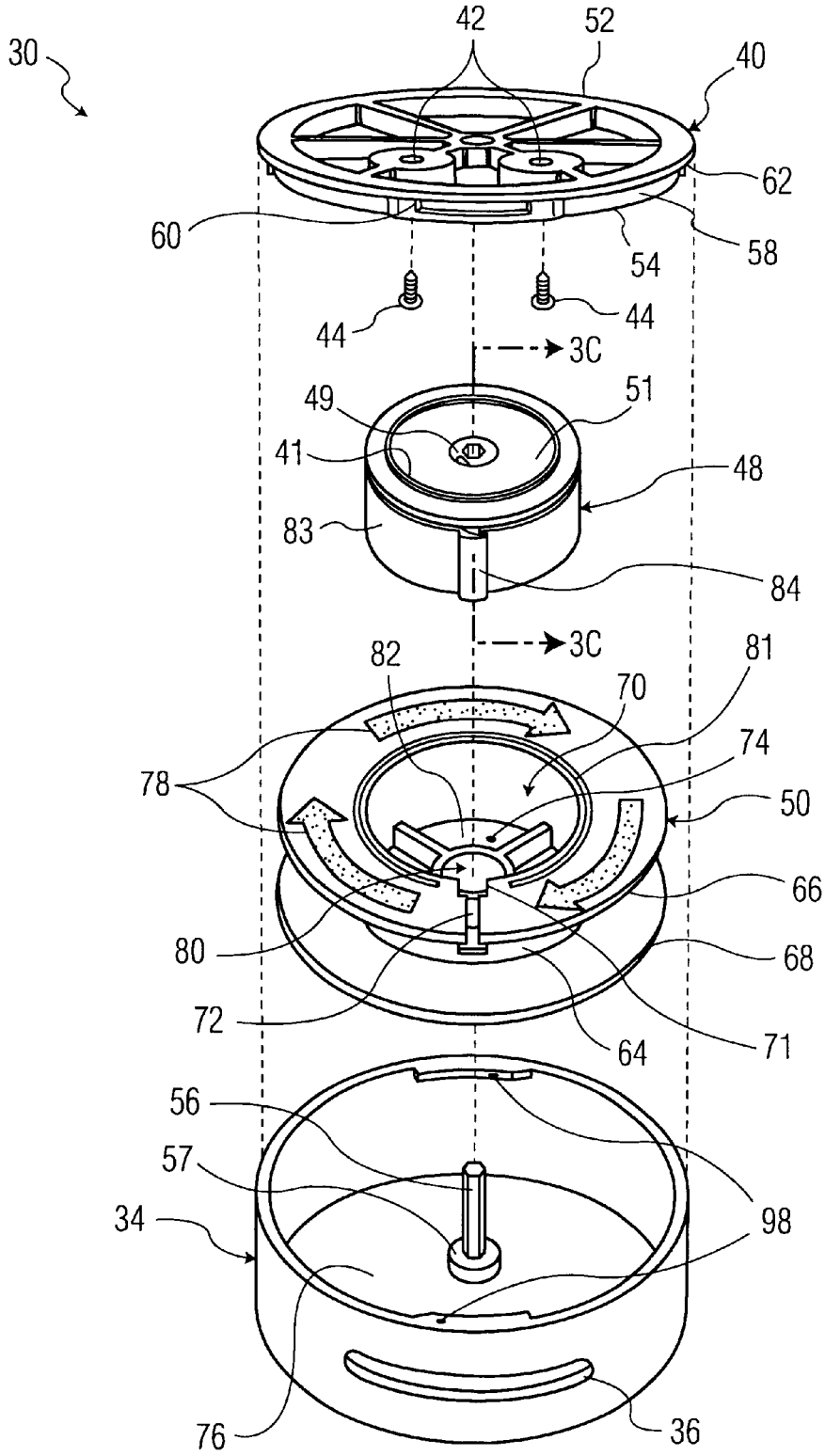
FIG. 3A is an exploded assembly view of the pull-cord keeper showing the component parts for one embodiment of the present invention.

With reference to FIG. 3A, the pull-cord keeper 30 is shown in an exploded assembly view for illustrating all of the component parts and the arrangement of such parts therein. The pull-cord keeper 30 generally includes the mounting plate 40, a pair of screw fasteners 44, a spring cartridge assembly 48, a spool member 50, and the cap member 34. The spring cartridge assembly 48 both fits into a central cavity of the spool 50 and includes a spindle 49 for rigid mounting on a hexagonal post 56 centrally located on the bearing surface 76 of cap member 34. The resulting assembly is fully enclosed within the cap member 34, with the mounting plate 40 being secured to the open end of the cap member 34.

Figure 4A:
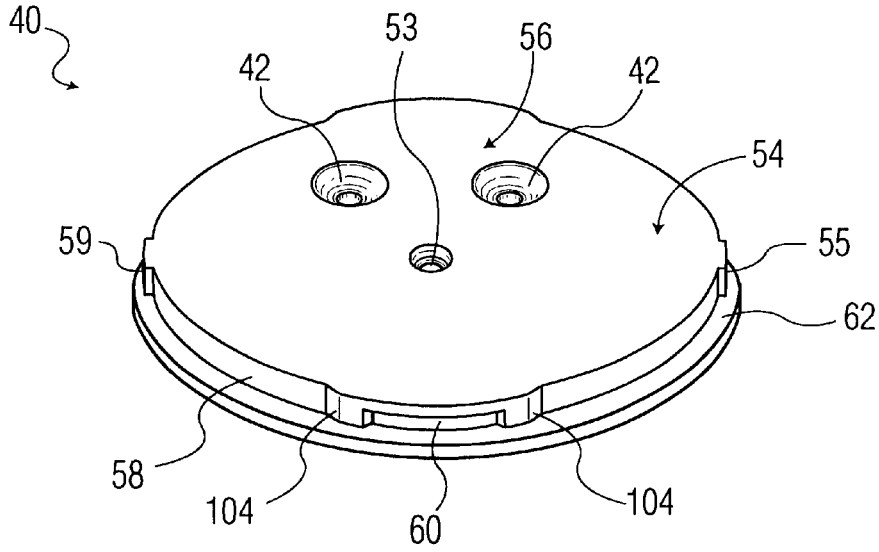
FIG. 4A is a perspective view of a mounting plate forming part of the pull-cord keeper for one embodiment of the present invention.
Figure 4B:
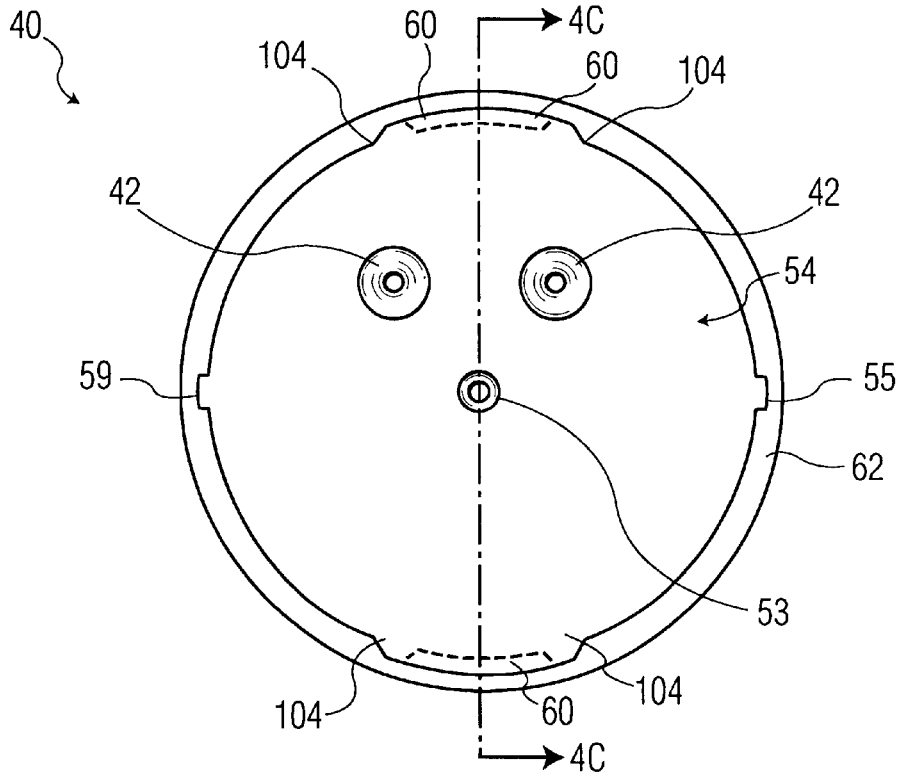
FIG. 4B is a top plan view of the mounting plate of FIG. 4A.

With reference to FIGS. 3A, 4A, and 4B, mounting plate 40 includes the mounting surface 52 on one side and a bearing surface 54 on an opposed interior side. In this embodiment, the mounting surface 52 is shown hogged out for reducing material usage and weight. The mounting surface 52 of the plate 40 is fastened to the wall 18 by the screw fasteners 44. The screw fasteners 44 are inserted through the chamfered screw holes 42 from the bearing side 54 into the wall 18 (see FIG. 1). The mounting plate 40 further includes a stepped portion 58 with ramp areas 104 on either side of a pair of opposed ramped projected recesses 60 formed circumferentially thereon, and a base flange 62 extending along the periphery thereof, a pair of opposed projecting tabs or protrusions 55, 59, located about 90° from said recesses 60, and a chamfered hole 53.

Figure 5A:
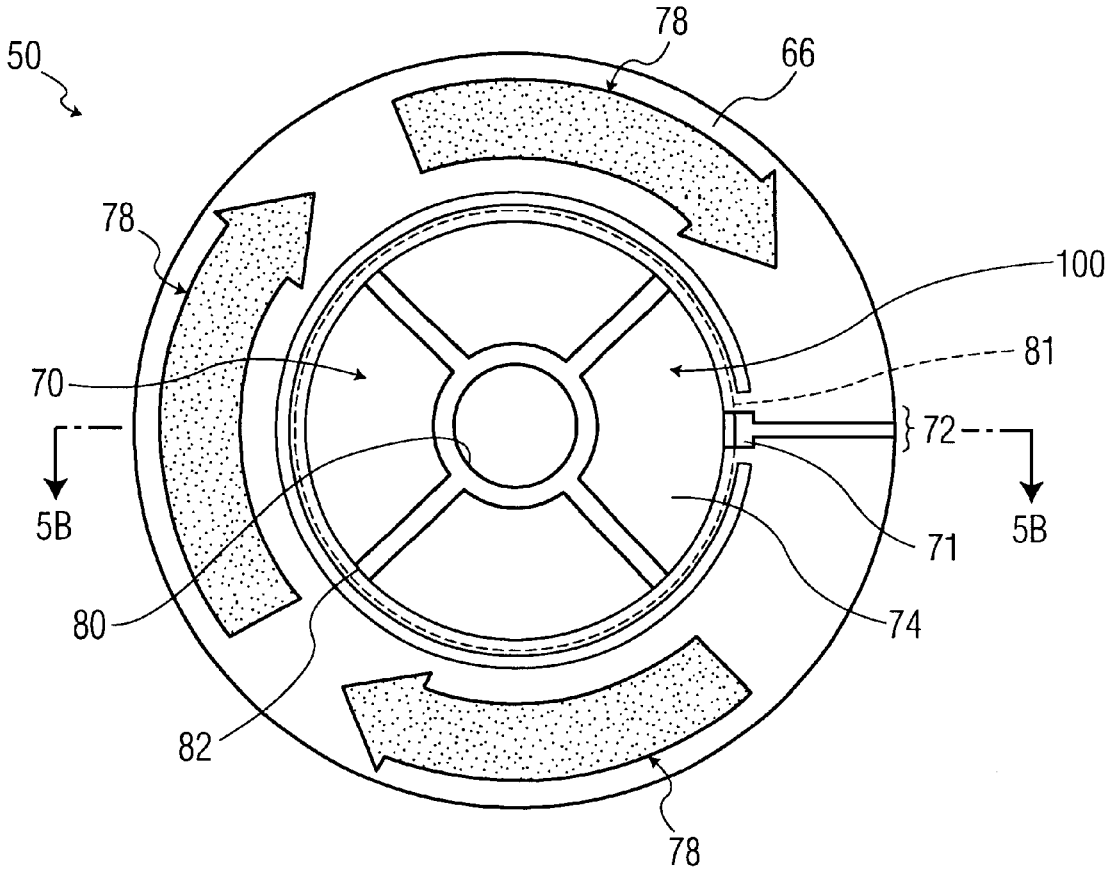
FIG. 5A is a top plan view of a spool forming part of the pull-cord keeper for one embodiment of the present invention.
Figure 5B:
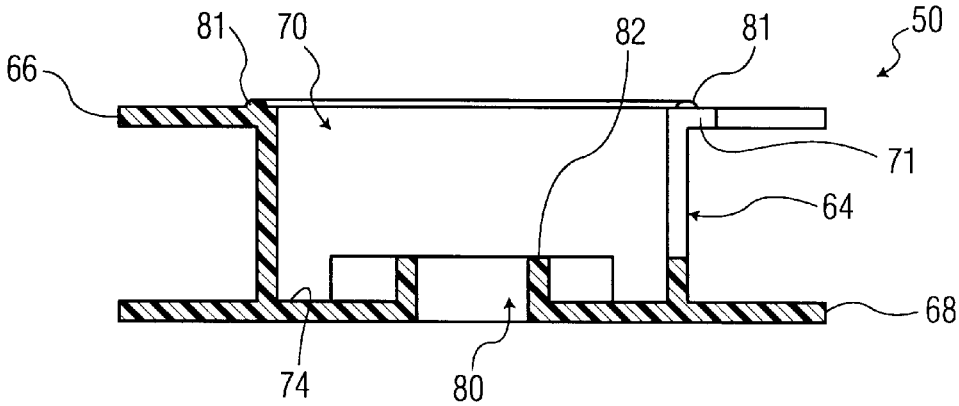
FIG. 5B is a cross sectional view of the spool taken along line 5B—5B of FIG. 5A.
Figure 6:
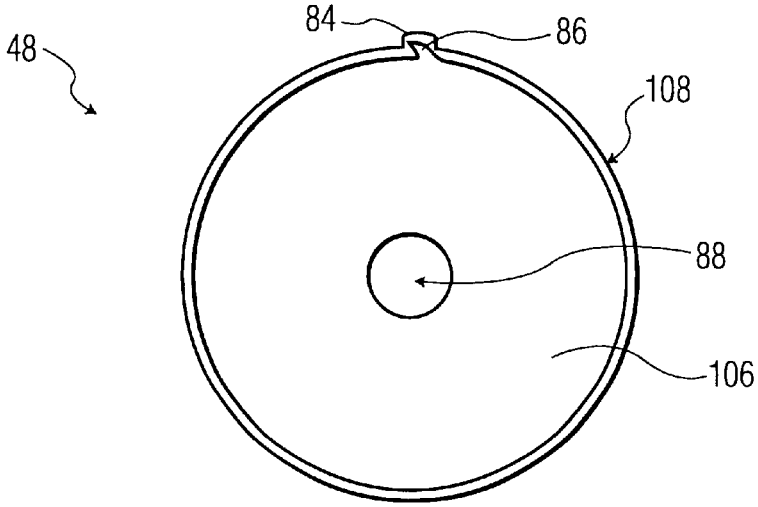
FIG. 6 is a top plan view of the housing of the spring cartridge of FIG. 3B and 3C with the cover or cap and spring removed for one embodiment of the present invention.

With reference to FIGS. 3A, 5A and 5B, the spool member 50 includes a cylindrical body 64 with first and second flanges 66 and 68, respectively, and an axial bore 70 therebetween, a slot 72 extending radially from the circumference of and through the first flange 66 and longitudinally in a widened area 71 through the side of the cylindrical body 64, and a base portion 74 at the lower end of the axial bore 70. The spool member 50 is free to rotate in a first direction on a bearing surface 76 of the cap member 34 for reeling a length of the pull-cord 4, and the rotation thereof in this direction being biased by the action of the coil spring 46. When the length of the pull-cord 4 is drawn from the keeper 30, the spool member 50 rotates in the opposite direction being resisted by the action of a coil spring 46 in spring cartridge assembly 48 (see FIG. 3B), for rotationally biasing the spool member 50 in the first direction, thus loading the spring 46 with each turn. The top surface of the first flange 66 of the spool member 50 includes a set of friction contact strips 78 formed thereon as will be described.

The slot 72 with widened area 71 of the spool 50 allows the free end of the pull-cord 4 to be inserted into the axial bore 70. The free end is preferably knotted to prevent the free end from slipping through the slot 72 and its widened area 71. The remaining length of the pull-cord 4 is wound around the cylindrical body 64 and captively retained between the flanges 66 and 68.

The base portion 74 and the axial bore 70 of the spool 50 forms a seat for the spring cartridge assembly 48. The base portion 74 further includes a centrally-located aperture 80 and a raised cupola 82 extending around the aperture 80. The cupola 82 forms a hollow (not shown) for accommodating the free end of the pull-cord 4 occupying the axial bore 70 and supports the bottom of the spring cartridge assembly 48 seated in the axial bore 70.

Figure 3B:
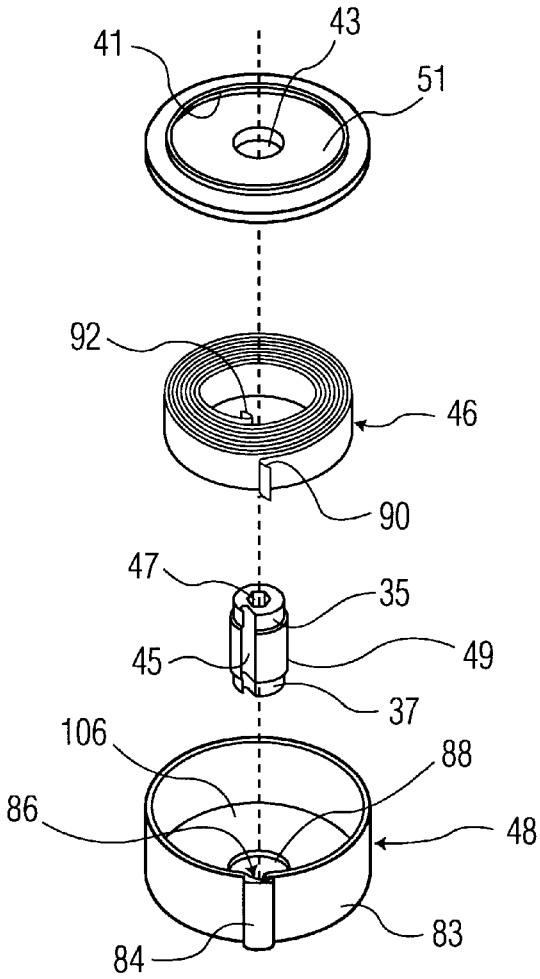
FIG. 3B is an exploded assembly view of a spring cartridge for an embodiment of the invention.
Figure 3C:
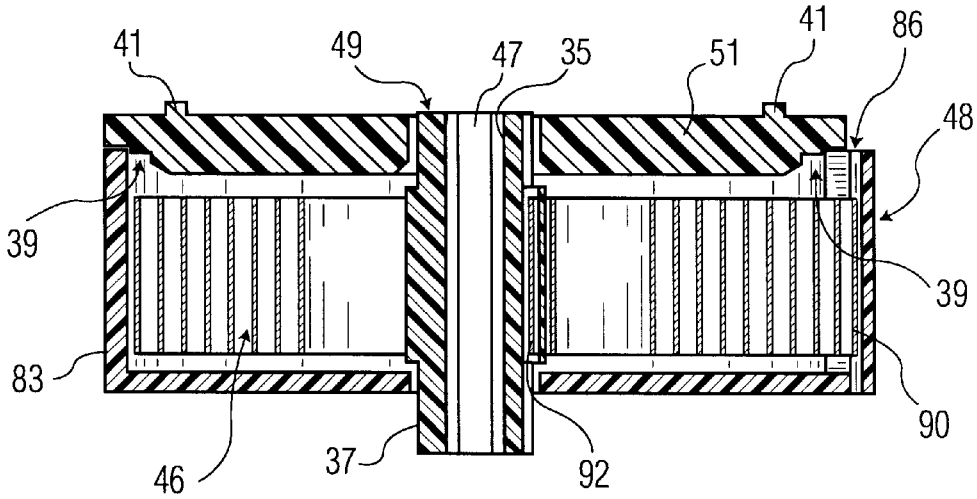
FIG. 3C is cross sectional view taken along line 3C—3C of the spring cartridge of FIG. 3A.
Figure 7:
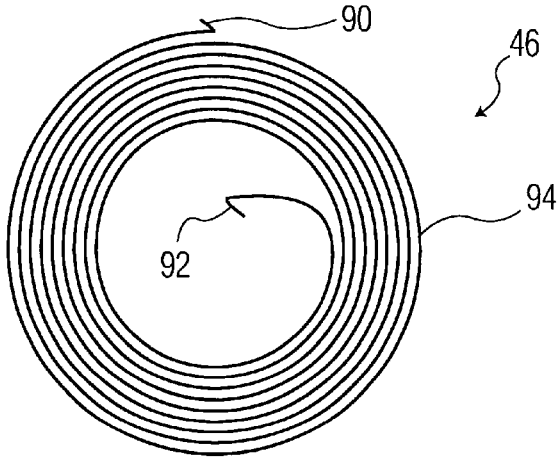
FIG. 7 is a top plan view of a coil spring forming part of the spring cartridge for one embodiment of the present invention.
Figure 8:
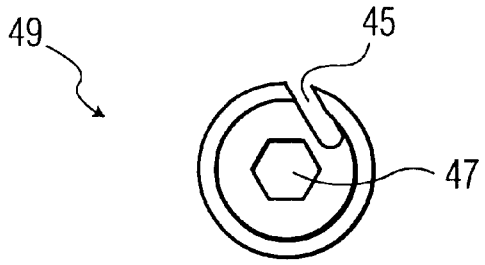
FIG. 8 is top plan view of a spindle included in the spring cartridge for one embodiment of the invention.
Figure 9:
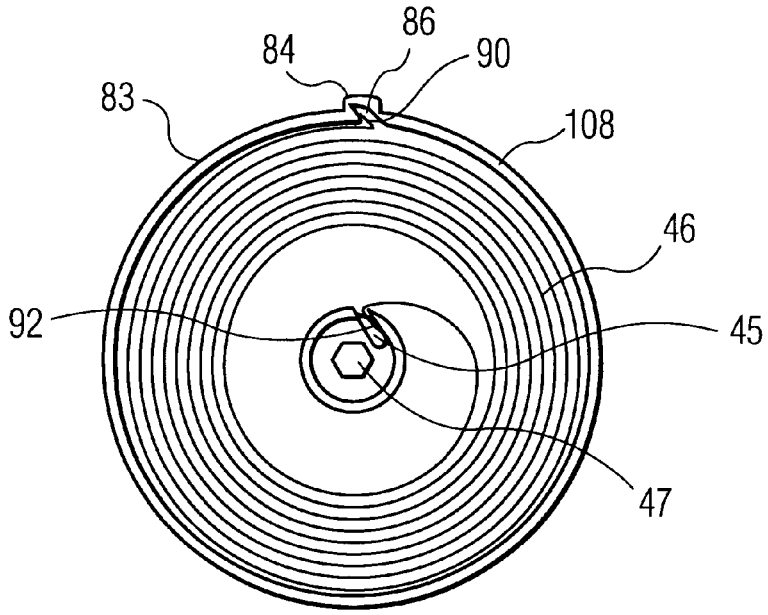
FIG. 9 is a top plan view of the spring cartridge with the associated spindle and spring installed, and the cover or cap removed.
Figure 10:
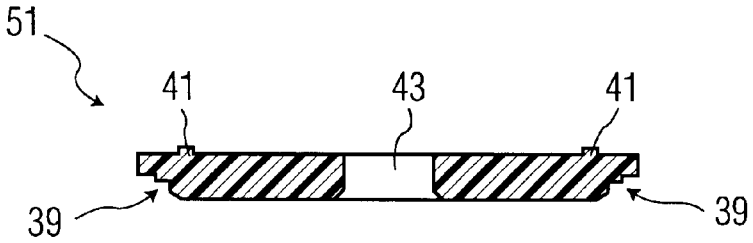
FIG. 10 is a cross sectional view of the cover or cap of the spring cartridge for an embodiment of the invention.

With reference to FIGS. 3A, 3B, 6, 7, 8, 9, and 10, the spring cartridge assembly 48 includes a case 83 having a ridge 84 extending longitudinally along the exterior side thereof, an angled notch 86 in the interior side thereof coinciding with the exterior ridge 84, and a centrally-located hole 88 in the bottom 106. The case 83 is configured to receive and retain therein the coil spring 46 and spindle 49. As shown in FIG. 7, the coil spring 46 includes an external tang 90 bent at an acute angle, an internal tang 92 bent at an acute angle, and a coiled body 94, in this example. The external tang 90 is adapted to be inserted and retained in the notch 86 of case 83 as shown in FIG. 9. The case 83 has an open top for receiving a lid member 51. The spindle 49 includes a hexagonal centrally located or axial through hole 47 for non-rotational mounting on post 56, a notch 45 for receiving and retaining tang 92 of spring 46, and reduced diameter end portions 35 and 37, respectively. As best shown in FIGS. 3B and 3C, when the spring cartridge assembly 48 is fully assembled, reduced ends 35 and 37 are retained in and protrude through holes 43 of lid 51, and 88 of case 83, respectively. As a result, the spindle 49 is double supported at its ends 35 and 37, in addition to being supported by post 56 in the fully assembled state. The lid 51 includes stepped portions 39 on a bottom circumferential flange for insuring a close fit on the top portion of case 83, whereby the lid 51 is rigidly secured to case 83 by electronic welding, or use of a suitable adhesive, for example. In this manner the spring 46 is sealed within case 83, thereby protecting users against injury by the spring rapidly unwinding and being ejected from case 83. With the spring cartridge assembly 48 seated within the axial bore 70 of the spool member 50, the ridge 84 is inserted and retained in the spool slot expanded or enlarged portion 71, with the bottom of the cartridge assembly 48 resting on the raised cupola 82 above the knotted free end of the pull-cord 4 (see FIG. 11).

Figure 4C:
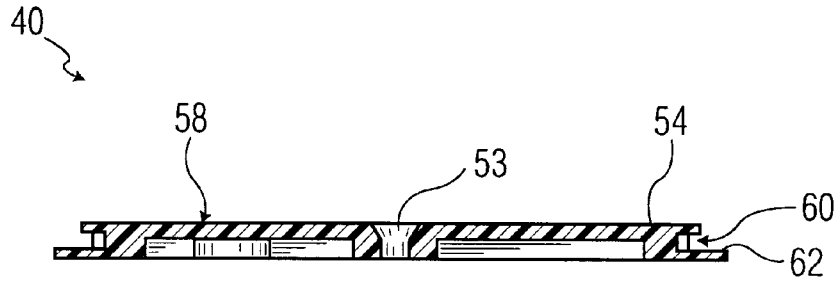
FIG. 4C is a cross sectional view of the mounting plate taken along line 4C—4C of FIG. 4B.

The pull-cord keeper 30 is assembled for sale or shipment to a user by installing spool member 50 into cap member 34. Hole 80 of spool member 50 receives bearing protrusion or bushing 57 formed at the bottom of post 56 on the bottom bearing surface 76 of cap member 34. The spring cartridge assembly 48 is inserted into the axial bore 80 of spool member 50 concurrent with pushing the hexagonal hole 47 of spindle 49 onto post 56. Next, the loaded cap member 34 must be mounted on the mounting plate 40. The cap member 34 further includes a pair of opposed ramped projection tabs 98 (see FIG. 3A) which cooperate with the pair of ramped projected recesses 60 of mounting plate 40 (see FIGS. 4A, 4B, and 4C) adapted for secure locking engagement. The cap member 34 is slipped over the mounting plate 40 where the edge portion of the cap member 34 contacts the top surface of the mounting plate flange 62 and the sides of the stepped portion 58. For locking of the cap member 34 to the mounting plate 40, the projected recesses 60 and the projection tabs 98 are positioned adjacent to each other. Then, the cap member 34 is rotated in either direction on the mounting plate 40 until the tabs 98 snaps into the projected recesses 60. The protrusions 55 and 59 of mounting plate 40 insure wobble free retention of mounting plate 40 on cap member 34. The cap member 34 can be removed from the mounting plate 40 by further rotating the cap member 34 until tabs 98 disengage the projected recesses 60. It is noted that the opening 36 of the cap member 34 in the locked position, should be directed towards the window treatment assembly 2 for efficient operation. Also note that the raised circular flange 41 serves as a bearing surface against the inside face of mounting plate 40.

The cap member 34, the mounting plate 40, the spring cartridge case 83, lid 51, spindle 49, and the spool 50 of the pull-cord keeper of the present invention consist of any durable and rigid material including, but not limited to, plastic materials such as polyamide, nylon, polyethylene, polychloropene, polyvinyl chloride, polyester, polypropylene, polystyrene, polytetrafluoro-ethene, and polyurethane, and the like. More preferably, the material consists of thermosetting plastics, for example, resins, melamine, polyester, Bakelite®, and the like. The coil spring 46 consists of an elastic, resilient material including, but not limited to, metals.

Referring to FIGS. 4A to 4C, and 11, the mounting plate 40 is shown in greater detail. It includes a centrally located chamfered hole 53 for receiving the free end of post 56 protruding from spring cartridge assembly 48. The mounting plate 40 also includes on opposing sides a pair of ramp areas 104 each located proximate to the projected recesses 60. The ramp areas 104 facilitate sliding of the cap member tabs 98 over the raised portion of the projected recesses 60 for tight coupling engagement between the tabs 98 and the projected recesses 60. It is also noted that the screw holes 42 are countersunk for setting the heads of the screws flush with the bearing surface 4 of the mounting plate 40.

Figure 11:
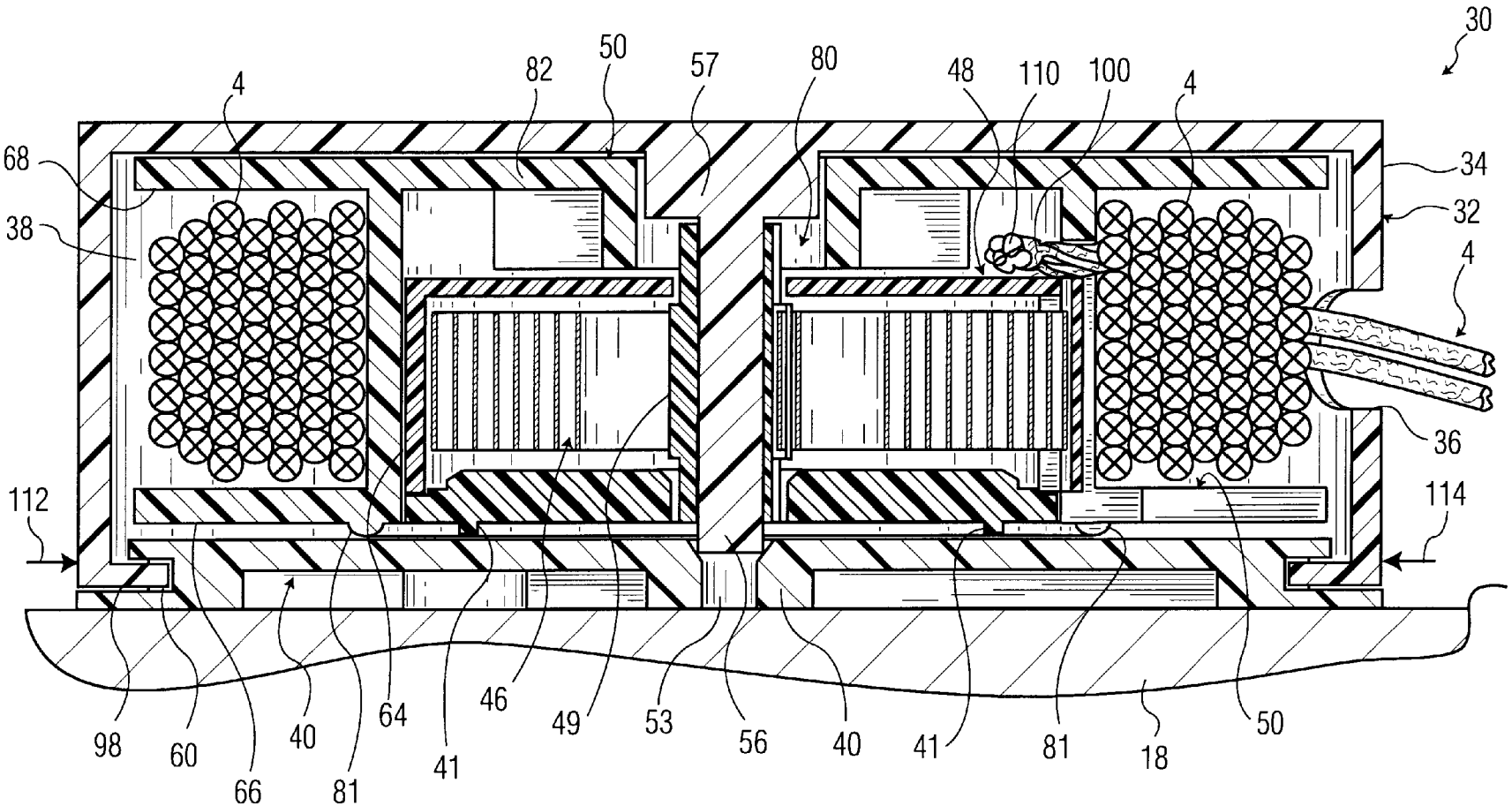
FIG. 11 is a cross sectional view of the pull-cord keeper for one embodiment of the present invention taken along line 11—11 of FIG. 1.

Referring to FIGS. 11, 5A and 5B, the spool member 50 is illustrated in greater detail. The top surface of the first flange 66 includes a circular ridge 81 to provide a bearing surface that cooperates with the bearing surface 54 of mounting plate 40. The second flange 68 includes a top surface that provides a bearing surface that cooperates with the inside bearing surface 76 of the cap member 34. These surfaces may slide against associated ones thereof. In addition, the edge portions of the flanges 66 and 68 also provide bearing surfaces corresponding with the interior circumferential surface of the cap member 34. Accordingly, the spool 50 can slidingly rotate in either direction within the housing 32 formed by the cap member 34 and the mounting plate 40. The slot 72 permits the knotted free end of the pull-cord 4 to be inserted into the hollow 100 of the base portion 74 and be captively retained therein by the spool slot 72 and the spring cartridge assembly 48.

The frictional contact strips 78 provided on the top surface of the first flange 66, include irregular surface contours for improving frictional contact between the spool 50 and a user's finger. During installation prior to use, the user is required to wind the free end of the pull-cord 4 into the pull-cord keeper 30. The frictional contact strips 78 assist and improve the user's gripping contact with the spool 50, and facilitate the winding up of the pull-cord 4 prior to mounting the cap member 34 to the mounting plate 40. The frictional contact strips 78 may include other forms such as finger indentations, rubber projections, protuberances, adhesive patches, and the like for improving the gripping contact with the user's finger on the spool 50. In this embodiment, the frictional contact strips 78 are each rendered in the shape of an arrow for indicating to the user the rotational direction of the spool 50 for winding up the pull-cord 4 during installation as will be described.

With reference to FIG. 11, the pull-cord keeper 30 is shown in cross section in the assembled form and mounted on a wall 18. Note that the post 56 is supported both at its free end in a hole 53 (see FIG. 4A) of mounting plate 40, and at its captive end by bushing 57. The knotted free end 106 of the pull-cord 4 is held captive in the hollow 100, and extends radially away through the spool slot 72 (as shown in FIG. 3A and 5A) and around the spool cylindrical body 64 prior to exiting the cap member opening 36. The spool 50 with the coiled pull-cord 4, the spring cartridge assembly 48, and the exterior tang 90 of spring 46 are rotatable as a single unit within the interior cavity 38 of the housing 32 around the spindle 49. During operation, the mounting plate 40, the interior tang 92 (as shown in FIG. 9), and the cap member 34 remain stationary. As the pull-cord 4 is being drawn from the spool 50, the coil spring 46 is wound up around the spindle body 56 into a spring loaded state. As the pull-cord 4 is released from the window treatment assembly 2 (i.e. window covering is raised), the spring loaded spool 50 is rotationally biased in the direction for winding up the relaxed length of the pull-cord 4 into the keeper 30.

During operation, the pull-cord keeper 30 is subject to substantial torque forces and stresses associated with repeated use. The locking interaction between the tabs 98 and the projected recesses 60 are further enhanced by the spindle body 56 biasing the central portion of the cap member 34 away from the mounting plate 40 as represented by arrow 112. This biasing effect causes the rim portion of the cap member 34 to press radially inward as represented by arrows 114. As a result, the tabs 98 are biased into the projected recesses 60 for a tighter, more secure fit. In order to remove the cap member 34, the cap member 34 must be rotated axially about the spindle body 56 to overcome the bias forces generated by the spindle body 56 on the cap member 34 to disengage the tabs 98 from the ramped projected recesses 60. Removal by pulling the cap member 34 away from the mounting plate 40 requires substantial force to be applied. This enhanced locking interaction substantially improves the overall durability and reliability of the pull-cord keeper 30.

With reference to FIGS. 1 to 8, the installation and operation procedures of the pull-cord keeper 30 will now be described. First, mounting plate 40 is removed from the pull-cord keeper 30, followed by removing spring cartridge assembly 48. A suitable point on the wall 18 proximate the upper portion of the window treatment assembly 2 is selected. The mounting plate 40 is fastened to the wall 18 at a desired height by use of the fastening screws 44. The pull-cord 4 of the window treatment assembly 2 is then drawn all the way out (i.e., raising the bottom rail 12 to the top of the window 5). The end of the pull-cord 4 is pulled through the opening 36 of the cap member 34. The free end of the pull-cord 4 of the window treatment assembly is knotted and placed into the axial bore 70 of spool 50. The knotted free end of the pull-cord 4 is next slipped into the spool slot 72. The cartridge spring assembly 48 is installed into the spool 50, as previously described. The spool assembly is then rotated in a clockwise direction or the direction indicated by the arrows rendered by the frictional contact strips 78 to wind up the pull-cord 4. As the pull-cord 4 is wound up, the cap member 34 is transported up to the mounting plate 40 on the wall 18. The frictional contact strips 78 improves the user's gripping contact on the spool 50 during rotation. In the preferred embodiment, the cap member 34 is oriented so that, upon locking, the opening 36 is directed towards the window treatment assembly 2. The cap member 34 is rotated on the mounting plate 40 into a locked position where the tabs 98 snap securely into the projected recesses 60.

For operation, the user simply manipulates the pull-cord 4 in the normal course of operating the window treatment assembly 2. The pull-cord keeper 30 automatically lets out or takes in the length of the pull-cord 4 as required to maintain a taut condition. No separate action on the part of the user is required for operating the pull-cord keeper 30. In this manner, the pull-cord 4 is always kept away from the reach of the infant or young child while permitting easy access to the adult user. Note that spring 46 is wound up or loaded as pull-cord 4 is drawn out, and unwinds as pull-cord 4 is wound up or drawn into pull-cord keeper 30.

Although various embodiments of the invention have been shown and described, they are not meant to be limiting. Those of skill in the art may recognize various modifications to these embodiments, which modifications are meant to be covered by the spirit and scope of the appended claims. It should be noted that the present invention is an improvement of the pull-cord keeper device shown in previously mentioned related U.S. Pat. No. 6,463,986, for facilitating and enhancing a user's installation and use of the device.

What is claimed is:

1. A pull-cord keeper for a window treatment assembly, said window treatment assembly including for operation a pull-cord, said keeper comprising:

a housing configured for secure mounting attachment on a wall near an upper portion of the window treatment assembly, said housing further including:

a mounting plate configured for rigid mounting at a desired height and location on the wall;

a cap member having a closed top, and an open bottom, an interior cavity, said cap member being adapted for attachment to one side of the mounting plate opposite the wall, said cap member including a mounting post centrally located and extending away from an interior surface of the top and toward the open bottom; and an opening extending through said cap member in communication with said cavity;

a spool adapted for rotational movement about said post within said cavity to reel and collect through said opening a length of said pull-cord, said spool including a central cavity;

a spring cartridge assembly adapted for mounting on said post and being retained within the cavity of said spool, and including means for spring biasing the spool in a rotational direction for reeling a length of the pull-cord during a constant spring-loaded state, for automatically and continuously collecting any loose length of said pull-cord; and said spool further including:

a cylindrical hub portion with first and second flanges extending radially outward at top and bottom ends thereof, respectively, said hub being hollow for defining said centrally located cavity open at said top end, said bottom end of said hub partially closing off said cavity with a centrally located hole therethrough, said hole being surrounded by a ring shaped bushing extending partially into said cavity, said bushing being adapted for rotatably receiving an interior end portion of said post, whereby said spool is rotatably disposed about said post; and a slot radially extending through said first flange and hub, said slot terminating at said second flange, said slot being adapted for receiving and retaining a free end of the pull-cord.

2. The pull-cord keeper of claim 1, wherein the cap member is cylindrical in shape.

3. The pull-cord keeper of claim 2, wherein the opening extending through said cap member extends circumferentially along a side portion thereof.

4. The pull-cord keeper of claim 1, wherein said spring cartridge assembly includes:

a case including:

a closed bottom with a centrally located hole, sidewalls extending upward from the bottom to an open top, and an exterior ridge extending outward from said sidewalls, and in alignment with a longitudinal axis of the hole in said bottom, a notch being included in an interior portion of said ridge;

a lid for closing off the open top of said case, said lid having a centrally located hole in axial alignment with the hole in the bottom of said case, said lid being configured for non-removable securement to said case;

a spindle having a cylindrical body with top and bottom ends of reduced diameter relative to the diameter of a main central portion, a notch being formed in an exterior portion of said body in parallel with the longitudinal axis thereof, a centrally located through hole between the top and bottom ends configured for non-rotatable mounting on said mounting post of said cap member; and a coil spring having an outer end configured for securement in the notch of said ridge of said case, and having an inner end configured for securement in the notch of said spindle.

5. The pull-cord keeper of claim 4, further including:

said slot of said spool including a widened portion proximate the cavity of said spool, said widened portion being configured for receiving the exterior ridge of said spring cartridge assembly.

6. The pull-cord keeper of claim 4, further including:

said post having its interior end portion of greater diameter than a major portion extending therefrom, the major portion having a hexagonal cross section; and the through hole of said spindle having a hexagonal shape for snugly and non-rotatably mounting on said post.

7. The pull-cord keeper of claim 4, wherein said lid further includes a raised circular flange providing a bearing surface against an inside face of said mounting plate.

8. The pull-cord keeper of claim 4, wherein said housing, spool, case, and lid each consist of a plastic material.

9. The pull-cord keeper of claim 4, wherein the coil spring consists of a metal material.

10. The pull-cord keeper of claim 1, wherein:

said mounting plate further includes along an edge portion a pair of opposing ramped projecting recesses; and said cap member further including along an inside rim portion a pair of opposing ramped tabs intercooperative with said ramped projecting recesses of said mounting plate, said ramped tabs being configured for tightly fitting within said ramped projecting recesses, via said cap member being rotated upon said mounting plate to a locking position where the tabs align radially with associated recesses, respectively, and mate therewith.

11. The pull-cord keeper of claim 10, wherein:

said mounting plate further includes along its inside rim portion, a pair of opposing protrusions located away from said pair of opposing ramped projecting recesses.

12. The pull-cord keeper of claim 11, wherein said pair of opposing protrusions are located 90° from said pair of opposing ramped projecting recesses.

13. A pull-cord keeper for a window treatment assembly, said window treatment assembly including for operation a pull-cord, said keeper comprising:

a housing configured for secure mounting attachment on a wall near an upper portion of the window treatment assembly, said housing further including:

a mounting plate configured for rigid attachment to the wall;

a cap member having a closed top, and an open bottom, said cap member being adapted for attachment to one side of the mounting plate opposite the wall; and a cavity being defined therebetween, whereby said cap member further includes an opening in communication with said cavity;

said mounting plate further including a pair of opposing ramped projecting recesses formed along an edge portion of the mounting plate;

said cap member further including a pair of opposing ramped tabs located along an inside rim portion of said cap member corresponding with said ramped projecting recesses, said ramped tabs being configured for snugly fitting within the ramped projecting recesses, when the cap member is rotated on the mounting plate to a locking position where the tabs align radially with the corresponding recesses and mate therewith;

a spool adapted for rotational movement within said cavity to reel and collect through said opening a length of said pull-cord; and a spring cartridge assembly including a closed case contained within a central portion of said spool, said case being locked to said spool for rotation therewith, said case enclosing a spring mechanism for biasing the spool in a rotational direction for reeling the length of the pull-cord during a constant spring-loaded state, for automatically and continuously collecting any loose length of said pull-cord.

14. The pull-cord keeper of claim 13, wherein said cap member includes on an inside face of its closed top portion a fixed bushing upon which said spool is mounted for rotation thereabout.

15. The pull-cord keeper of claim 14, further including:

a centrally located post protruding from said bushing toward the open bottom of said cap member; and said spring mechanism including:

a spindle having opposing ends adapted for retention in opposing holes in top and bottom portions of said case, said spindle having a centrally located axial through hole adapted for non-rotational mounting upon said post, said case being rotatable about said spindle; and a spring having one end secured to said spindle, and another end secured to an inside portion of a sidewall of said case.

16. The pull-cord keeper of claim 15, wherein said spring is a coil spring mounted on said spindle.

17. The pull-cord keeper of claim 15, wherein said housing, spool, case, spindle, and bushing each consist of plastic material.

18. The pull-cord keeper of claim 15, wherein said spring consists of metal material.

19. A pull-cord keeper for a window treatment assembly, said window treatment assembly including for operation a pull-cord, said keeper comprising:

a housing configured for secure mounting attachment on a wall near an upper portion of the window treatment assembly, said housing further including:

a mounting plate configured for mounting attachment to the wall;

a cap member having a closed top and an open bottom, said cap member being adapted for attachment to one side of the mounting plate opposite the wall; and a cavity being defined therebetween;

fastening means for securely mounting said mounting plate to the wall;

an opening extending through said housing in communication with said cavity;

a spool adapted for rotational movement within said cavity to reel and collect through said opening a length of said pull-cord;

a sealed spring cartridge assembly contained within a central portion of said spool, including a spring for biasing the spool in a rotational direction for reeling the length of the pull-cord during a constant spring-loaded state, for automatically and continuously collecting any loose length of said pull-cord;

said mounting plate further includes a pair of opposing ramped projecting recesses formed along an edge portion of the mounting plate; and said cap member further includes a pair of opposing ramped tabs located along an inside rim portion of said cap member corresponding with said ramped projecting recesses, said ramped tabs being configured for snugly fitting within the ramped projecting recesses, when the cap member is rotated on the mounting plate to a locking position where the tabs align radially with the corresponding recesses and mate therewith.

20. The pull-cord keeper of claim 19, wherein said spring is a coil spring.

* * * * *